US007955137B2

(12) United States Patent
Ko et al.

(10) Patent No.: US 7,955,137 B2
(45) Date of Patent: Jun. 7, 2011

(54) LOWER PROFILE CABLE ASSEMBLY

(75) Inventors: David Ko, Fullerton, CA (US); Chang-Mao Li, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/853,295

(22) Filed: Aug. 10, 2010

(65) Prior Publication Data

US 2011/0034083 A1 Feb. 10, 2011

(30) Foreign Application Priority Data

Aug. 10, 2009 (CN) ..... 2009 2 0607646

(51) Int. Cl.
*H01R 24/00* (2006.01)

(52) U.S. Cl. ..... 439/660; 439/607.45

(58) Field of Classification Search ..... 439/660, 439/607.45, 607.51
See application file for complete search history.

(56) References Cited

U.S. PATENT DOCUMENTS

| | | | | |
|---|---|---|---|---|
| 2008/0064265 | A1 * | 3/2008 | Sterling et al. | 439/660 |
| 2009/0047839 | A1 * | 2/2009 | Wu | 439/660 |
| 2009/0117784 | A1 * | 5/2009 | Wu | 439/660 |
| 2009/0124133 | A1 * | 5/2009 | Tsai | 439/660 |
| 2009/0124134 | A1 * | 5/2009 | Moriyama et al. | 439/660 |

FOREIGN PATENT DOCUMENTS

CN 200720058452 9/2007

* cited by examiner

*Primary Examiner* — Hien Vu
(74) *Attorney, Agent, or Firm* — Wei Te Chung; Andrew C. Cheng; Ming Chieh Chang

(57) ABSTRACT

A cable assembly includes an insulative housing, a number of contacts retained in the insulative housing and a metal shell covering the housing to form a receiving space with the tongue portion for receiving an electrical plug. The housing has a base portion and a tongue portion extending forwardly from the base portion. The contacts consist of two pairs of differential signal contacts and a pair of grounding contacts between the two pairs of differential signal contacts. Each contact has a contact portion. All contact portions are arranged in a row on one side of the tongue portion.

16 Claims, 6 Drawing Sheets

LOWER PROFILE CABLE ASSEMBLY

BACKGROUND OF THE INVENTION

1. Field of the Invention

The present invention relates to a cable assembly, more particularly to a lower profile cable assembly for high speed transmitting.

2. Description of Related Art

CN Pat. No. 200720058542 issued on Sep. 17, 2007 to Xu discloses a cable assembly according to High Definition Multimedia Interface (HDMI) standard. The cable assembly includes an insulative housing, nineteen terminals supported by the insulative housing, an insulator mounted to a back side of the insulative housing and a metallic shell shrouding the insulative housing. The terminals are arranged into two distinct rows along a vertical direction. The insulator defines a plurality of grooves in upper and lower sides thereof. Tail portions of the terminals are accommodated in the grooves, respectively. Wires of the cable assembly are soldered to the tail portions of the terminals.

HDMI cable connectors are widely used in consumer electronic devices for electrically connecting the electronic devices with each other to transmit signals. The HDMI cable connector has nineteen contacts arranged in two rows and including three pairs of differential contacts (Data+, Data−), a pair of clock contacts (Clock+, Clock−), five grounding contacts, a CEC signal contact, a SCL signal contact, a SDA signal contact, a reserved signal contact, a +5V power contact, and a hot plug detect contact. It is to see that the HDMI cable connector has so many types of the contacts sorted in function that the chipset designed for the HDMI cable connector is complicated. The HDMI cable connector need many contacts to transmit so many different types of data, and the manufacturing costs of the C type HDMI connector is increased.

Hence, an improved cable connector is desired to overcome the above problems.

BRIEF SUMMARY OF THE INVENTION

Accordingly, an object of the present invention is to provide a lower profile and easily manufactured cable assembly.

In order to achieve the object set forth, a cable assembly in accordance with the present invention comprises an insulative housing having a base portion and a tongue portion extending forwardly from the base portion, a cavity defined in a top side of the tongue portion; a plurality of terminals received in the housing, the terminals arranged in a row along a transversal direction and consisting of two differential pairs and two grounding terminal between the two differential pairs, each terminal having a contacting portion extending into the cavity in the tongue portion; and a cable having plurality of wires electrically connected to the terminals.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
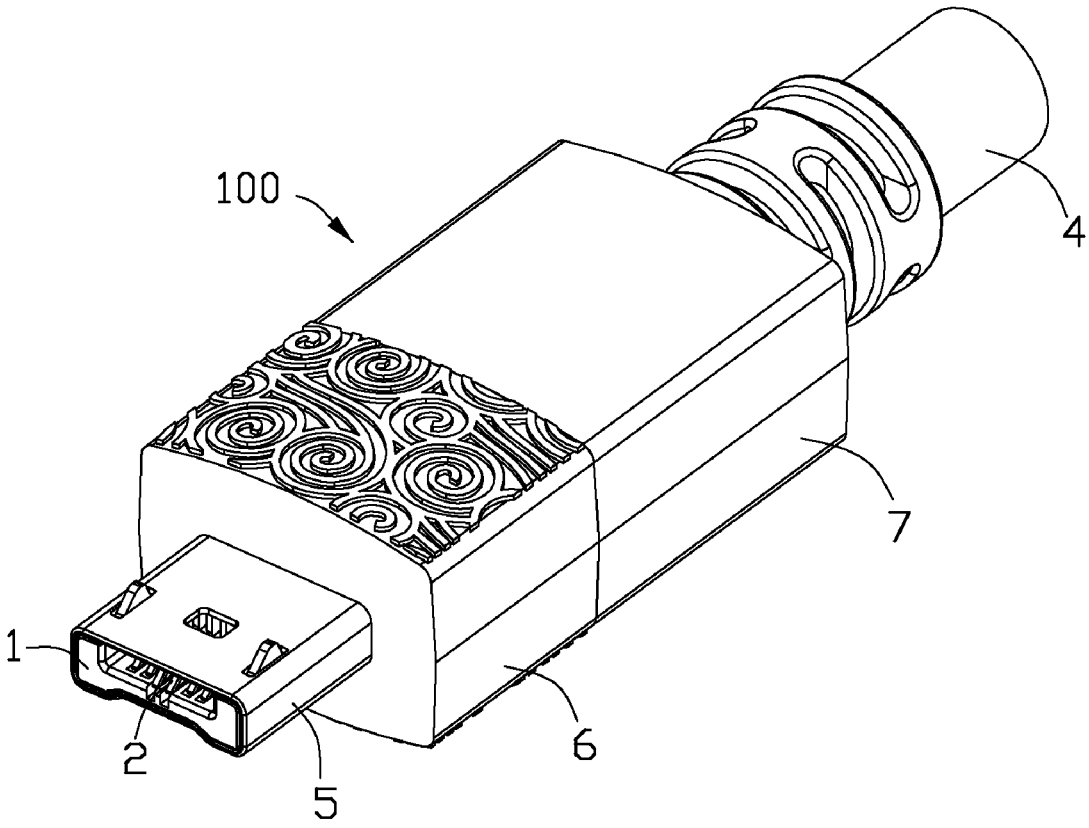
FIG. 1 is a perspective view of a cable assembly according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
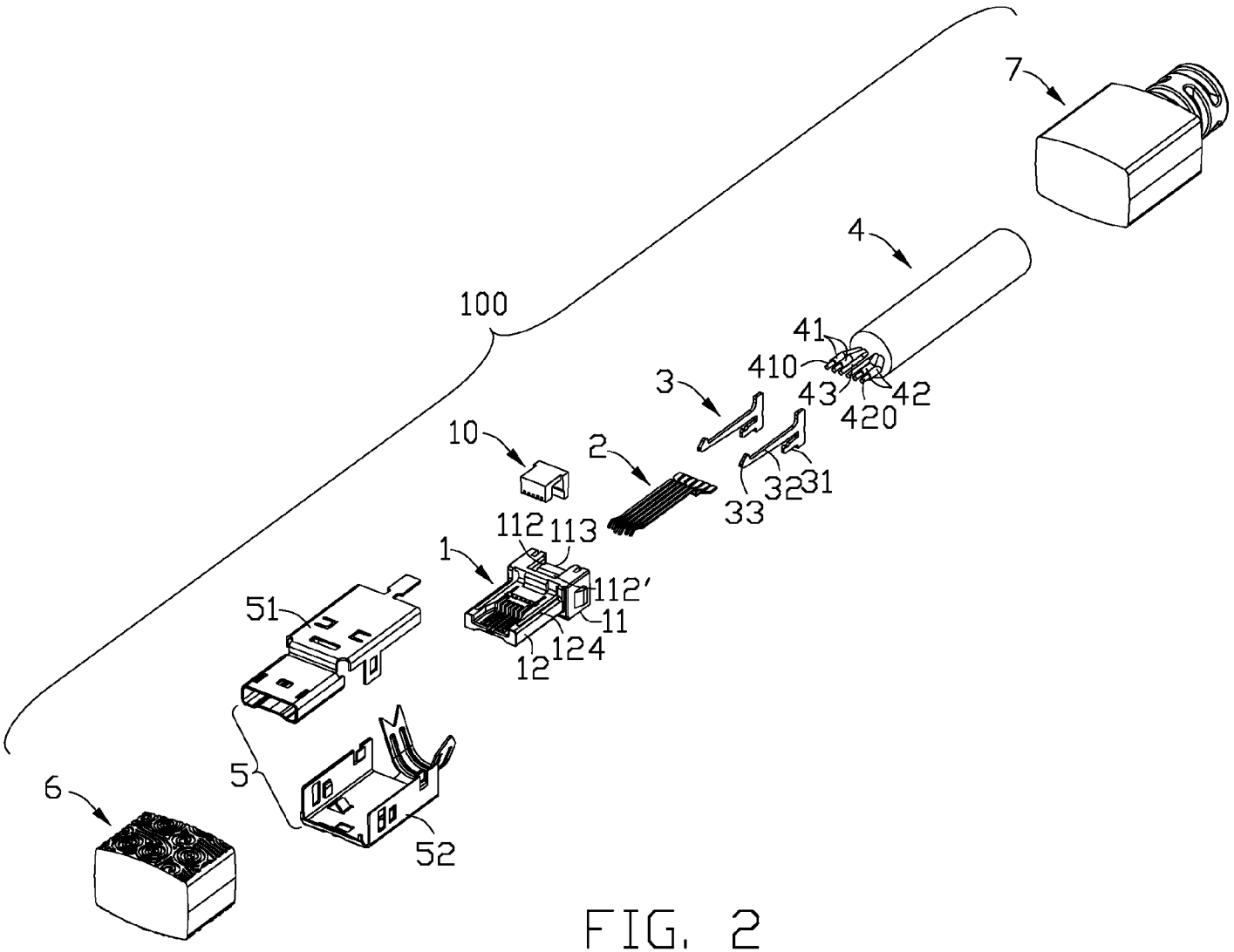
FIG. 2 is an exploded view of the cable assembly shown in FIG. 1.
Figure 3:
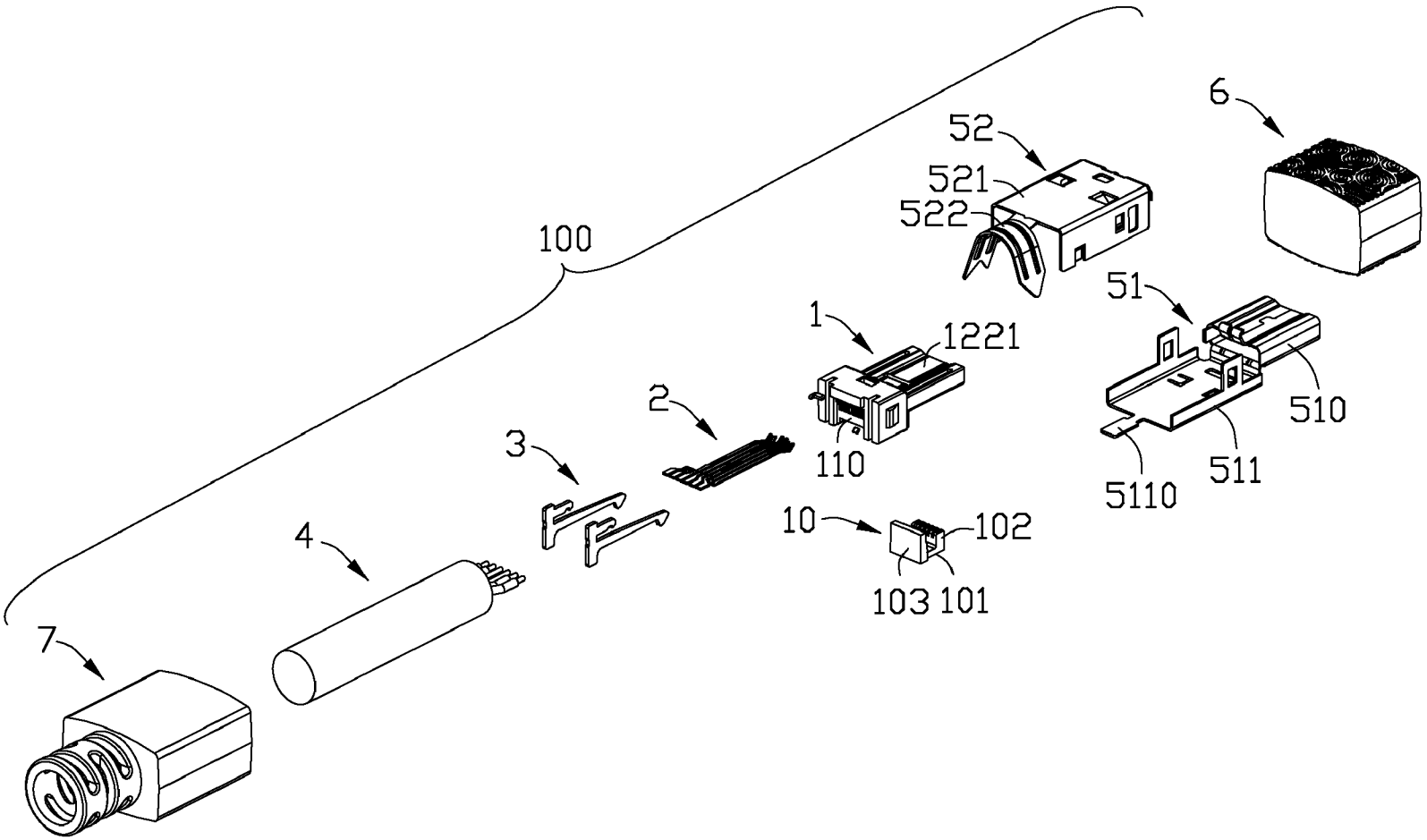
FIG. 3 is a view similar to FIG. 2, while taken from a different aspect.
Figure 4:
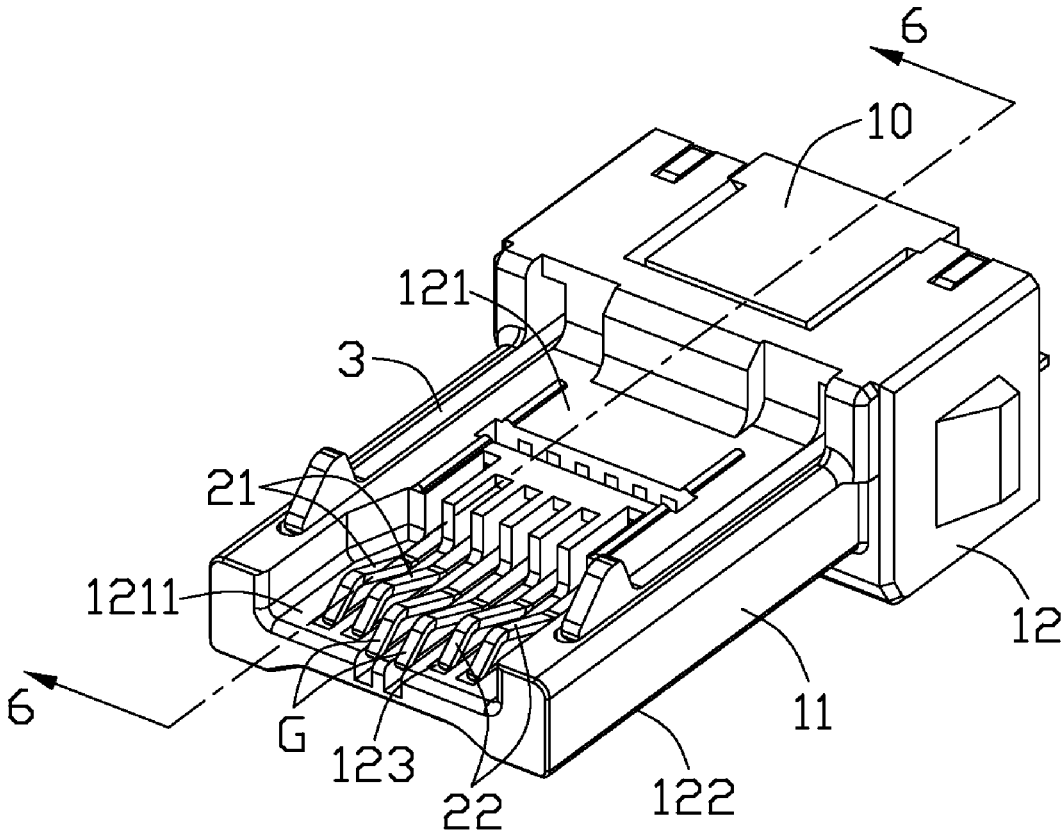
FIG. 4 is a partially assembled view of the cable assembly.
Figure 5:
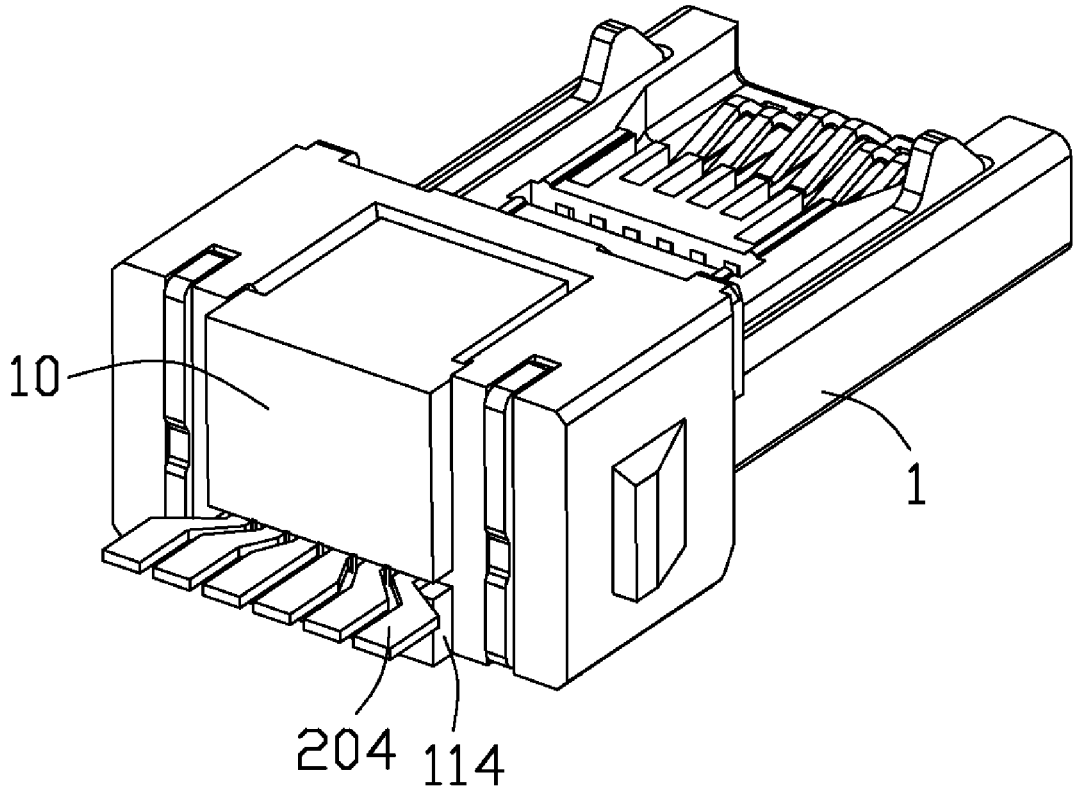
FIG. 5 is a view similar to FIG. 4, but viewed from other direction.
Figure 6:
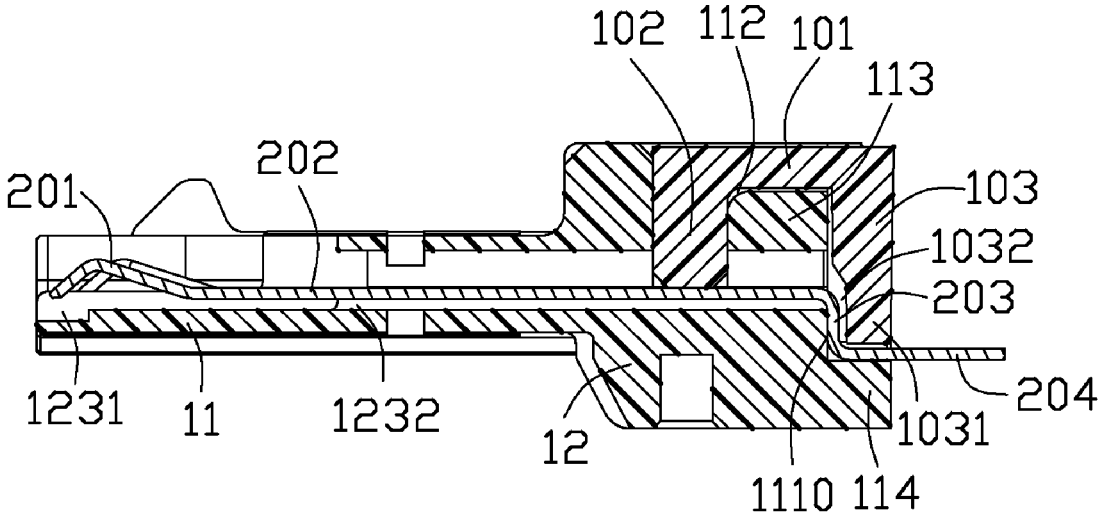
FIG. 6 is a cross-section view of the FIG. 4 taken along line 6-6.

Referring to FIGS. 1-6, a cable assembly 100 in the present invention is in accordance with a miniature DiiVA (Digital Interactive Interface for Video & Audio) standard.

The cable assembly 100 includes an insulative housing 1, a positioning member 10 mounted to a back segment of the insulative housing 1, a plurality of terminals 2 received in the insulative housing 1, a pair of latching members 3 mounted to the insulative housing 1, a cable 4 for electrically connecting with the terminals 2, a metallic shell 5 shrouding the insulative housing 1, a front cover 6 attached to a front segment of the metallic shell 5 and a back cover 7 attached to a back segment of the metallic shell 5 and the cable 4.

The insulative housing 1 includes a base portion 11 and a tongue portion 12 extending forwardly from the base portion 11. The tongue portion 12 has a top side 121 and a bottom side 122 opposite to the top side 122. A cavity 1211 is defined in the top side 121 and a depression 1221 is defined in the bottom side 122.

There are six terminal slots 123 defined in the insulative housing and arranged in a row along a transversal direction. The terminal slots 123 forwardly extend into the cavity 1211 and backwardly extend outward through the base portion 11. A front portion 1231 of the terminal slot 123 is deeper than the other portion 1232 of the terminal slot 123. Two mounting slots 124 are defined in lateral sides of the insulative housing 1.

The base portion 11 defines a first positioning cavity 112 in a top side of a back portion thereof, and a second positioning cavity 112' is located in the front portion of the first positioning cavity 112. Therefore, a stopper 113 is formed under the first positioning cavity 112 and disposed behind the second positioning cavity 112'. A recess 110 extends into the base portion 11 form a back edge thereof, and a flange 114 is located underneath the recess 110.

There are six terminals 2 arranged in a row along the transversal direction. The six terminals 2 consist of one differential pair 21 for unidirectionally transmitting video signals, the other differential pair 22 for bidirectionally transmitting hybrid signals and two grounding contacts G disposed between the differential pairs 21, 22. As there are two grounding contacts G arranged between the two differential pairs 21, 22, and a distance between the two differential pairs 21, 22 increases and cross-talk problem is declined. In addition, the grounding contacts G are proximate to a front edge of the tongue portion 12, which can pre-contact with a complementary connector (not shown) to eliminate electrostatic problem.

Each terminal 2 has a planar retention portion 202 disposed at a first level, a curved contacting portion 201 extending forwardly from the retention portion 202, a tail portion 204 disposed at a second level lower than the first level and a connecting portion 203 joining the retention portion 202 and the tail portion 204. The contacting portion 201 extends into the cavity 1211 and disposed above the front portion 1231 of the corresponding terminal slot 123. The retention portion 202 is accommodated in the terminal slot 123. The connecting portion 203 abuts against inward side 1110 of the recess 110. The tail portion 204 is supported by the flange 114 and backwardly projects beyond the rear edge of the base portion 11.

The positioning member 10 has a horizontal main part 101, a first arm 103 downwardly extending from a back end of the main part 101, a second arm 102 downwardly extending from a front end of the main part 101. The first arm 103 is longer than the second arm 102. A concave 1032 is defined in an inner side of a lower segment of the first arm 103.

The positioning member 10 is assembled to the base portion 12 of the insulative housing along a up-to-down direction. The main portion 101 is received in the first positioning cavity 112. The second arm 102 is inserted into the second positioning cavity 112' and further presses onto the retention portion 202 of the terminal 2. The stopper 113 is located behind the second arm 102. The first arm 103 extends into the recess 110 and presses onto the tail portion 204 of the terminal 2. Thus, the terminals 2 combine with the insulative housing 1 more reliably.

Each latching member 3 has a L-shaped retaining segment 31, a latching arm 32 forwardly extending from the retaining segment 31. The retaining segment 31 engages with the base portion 11. The latching arm 32 124 is accommodated in the mounting slot 124. A hook 33 is formed at a front end of the latching arm 32.

The cable 4 includes a pair of first signal wires 41, a pair of second signal wires 42 and a pair of grounding wires 43. Each first signal wire 41 has a first conductor 410 which is soldered to the corresponding tail portion 204 of the differential pair 21. Each second signal wire 42 has a second conductor 420 which is soldered to the corresponding tail portion 204 of the differential pair 22. The grounding wires 43 are soldered to the tail portions 204 of the grounding terminals G.

The metallic shell 5 includes a first shell 51, a second shell 52. The first shell 51 has a frame 510, an inverted U-shaped body 511 connected to the frame 510 and a tab 5110 projecting backwardly from the inverted U-shaped body 511. The second shell 52 has a U-shaped body 521 and a holding segment 522 projecting backwardly from the U-shaped body 521. The insulative housing 1 is firstly mounted to the first shell 51, with the tongue portion 11 received in the frame 510, the base portion 12 accommodated in the inverted U-shaped body 511. The second shell 52 is assembled to the first shell 51, with the U-shaped body 521 latching with the inverted U-shaped body 511. The holding segment 522 grips the cable 4 and the tab 5110. A bottom side of the frame 510 is inwardly recessed to match with the depression 1221 of the tongue portion 12.

The front cover 6 is molded over a back segment of the frame 510, front segments of the inverted U-shaped body 511 and the U-shaped body 521. The back cover 7 is molded over rear segments of the inverted U-shaped body 511 and the U-shaped body 521, the holding segment 522 and partial of the cable 4 adjacent to the holding member 522. In alternative embodiment, the front cover 6 and the back cover may be a unitary body.

There are only six terminals 2 of the cable assembly 100, thus it is relatively simply to manufacture the cable assembly 100. Therefore, less material is needed to finish the cable assembly 100 and thus the cable assembly 100 also has a lower profile.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an insulative housing having a base portion and a tongue portion extending forwardly from the base portion, a cavity defined in a top side of the tongue portion;

a plurality of terminals received in the insulative housing, the terminals arranged in a row along a transversal direction and consisting of two differential pairs and two grounding terminals between the two differential pairs, each terminal having a contacting portion extending into the cavity in the tongue portion; and a cable having plurality of wires electrically connected to the terminals;

wherein one differential pair unidirectionally transmits video signal and the other differential pair bidirectionally transmits hybrid signal;

wherein each of the terminals has a retention portion and a tail portion disposed behind the retention portion and lower than the retention portion;

wherein there is a U-shaped positioning member assembled to the base portion of the insulative housing to position the terminals;

wherein a metallic shell shrouding the insulative housing.

2. The cable assembly as claimed in claim 1, wherein the base portion defines a first positioning cavity in a top side thereof and a second positioning cavity located in the front portion of the first positioning cavity, the positioning member has a main part accommodated in the first positioning cavity and one arm downwardly extending from a front end of the main part and inserted into the second positioning cavity to press the retention portions of the terminals.

3. The cable assembly as claimed in claim 2, wherein there is other arm downwardly extending form a back end of the main part and presses onto the tail portions of the terminals.

4. The cable assembly as claimed in claim 3, wherein there is a recess extends into the base portion form a back edge thereof, and the other arm is received in the recess.

5. The cable assembly as claimed in claim 4, wherein the base portion has a flange located underneath the recess.

6. The cable assembly as claimed in claim 5, wherein the tail portions of the terminals are supported by the flange.

7. The cable assembly as claimed in claim 4, wherein the terminals further have connecting portions joining the retention portions and the tail portions.

8. The cable assembly as claimed in claim 7, wherein the connecting portions abut against an inward side of the recess.

9. The cable assembly as claimed in claim 7, wherein there is a concave defined in an inner side of the first arm.

10. The cable assembly as claimed in claim 1, wherein there is a cover molded over the metallic shell and the cable adjacent the metallic shell.

11. A cable assembly comprising:

an insulative housing defining a base portion and a tongue portion extending forwardly thereform, a mating port formed on around the tongue portion;

a plurality of terminal slots extending forwardly in both said base portion and said tongue portion;

a plurality of terminals consisting of two differential pairs and two grounding terminals between the two differential pairs forwardly inserted into the corresponding terminal slots, respectively, each of said terminals defining an upper horizontal section within the corresponding terminal slot and a lower horizontal section exposed outside of the corresponding terminal slot;

a U-shaped insulative positioning member assembled to the housing in a direction and defining an inner arm extending into the corresponding terminal slots to abut against the upper horizontal sections, and an outer arm abutting against the lower horizontal sections;

wherein one differential pair unidirectionally transmits video signal and the other differential pair bidirectionally transmits hybrid signal.

12. The cable assembly as claimed in claim 11, wherein said direction is downward vertically.

13. The cable assembly as claimed in claim 11, wherein each of said terminals defines an upward section connected between the upper horizontal direction and said lower horizontal direction, and said outer arm abuts against said the upward sections forwardly.

14. The cable assembly as claimed in claim 13, wherein said upward section extends vertically.

15. An electrical cable connector comprising:

an insulative housing defining a base portion and a tongue portion extending forwardly therefrom, said tongue portion defines a step structure around a middle region in a front-to-back direction so as to upper platform and a lower platform thereof with a mating cavity formed above the lower platform;

a metallic shell enclosing said housing and intimately shielding the upper platform while spaced from the lower platform with said mating cavity;

a plurality of terminal slots extending in both the base portion and the tongue portion; and a plurality of terminals consisting of two differential pairs and two grounding terminals between the two differential pairs disposed in the corresponding terminal slots, respectively, each of said terminals defining a resilient contacting section located on a front portion thereof and extending into the mating cavity in a vertical direction perpendicular to said front-to-back direction;

wherein said mating cavity defining a first transverse dimension around a front opening forwardly communicating with an exterior, and a second transverse dimension around the step structure, said second transverse dimension being smaller than said first transverse dimension;

wherein one differential pair unidirectionally transmits video signal and the other differential pair bidirectionally transmits hybrid signal; and wherein there is a U-shaped positioning member assembled to the base portion of the insulative housing to position the terminals.

16. The electrical cable connector as claimed in claim 15, wherein a transverse slot is formed in the upper platform to communicate said terminal slots with the exterior in the vertical direction when said shell is removed from the housing.

* * * * *